US008240085B2

(12) United States Patent
Hill

(10) Patent No.: US 8,240,085 B2
(45) Date of Patent: Aug. 14, 2012

(54) RFID PET DOOR

(76) Inventor: Nicholas Patrick Roland Hill, Cambridge (GB)

( * ) Notice: Subject to any disclaimer, the term of this patent is extended or adjusted under 35 U.S.C. 154(b) by 344 days.

(21) Appl. No.: 12/443,773

(22) PCT Filed: Sep. 13, 2007

(86) PCT No.: PCT/GB2007/050540

§ 371 (c)(1),
(2), (4) Date: Jan. 15, 2010

(87) PCT Pub. No.: WO2008/041016

PCT Pub. Date: Apr. 10, 2008

(65) Prior Publication Data

US 2010/0126071 A1 May 27, 2010

(30) Foreign Application Priority Data

Oct. 3, 2006 (GB) ..... 0619489.8

(51) Int. Cl.
*E05D 15/48* (2006.01)

(52) U.S. Cl. ..... 49/169; 160/180

(58) Field of Classification Search ..... 49/163, 49/169; 160/180; 119/484, 501
See application file for complete search history.

(56) References Cited

U.S. PATENT DOCUMENTS

| | | | | | |
|---|---|---|---|---|---|
| 4,022,263 | A * | 5/1977 | Beckett et al. | 160/92 |
| 4,216,743 | A * | 8/1980 | Cohen | 119/484 |
| 4,421,058 | A * | 12/1983 | Paul | 119/484 |
| 4,991,350 | A * | 2/1991 | Kirk | 49/169 |
| 5,469,659 | A * | 11/1995 | Reid et al. | 49/169 |
| 5,701,702 | A * | 12/1997 | Reid et al. | 49/169 |
| 5,813,364 | A * | 9/1998 | Harrison | 119/501 |
| 5,992,096 | A * | 11/1999 | De La Cerda et al. | 49/169 |
| 6,141,911 | A * | 11/2000 | Reid | 49/394 |
| 6,297,739 | B1 * | 10/2001 | Small | 340/573.3 |
| 6,453,847 | B2 * | 9/2002 | Brooks | 119/484 |
| 6,681,524 | B1 * | 1/2004 | Tillson | 49/169 |
| 6,944,990 | B2 * | 9/2005 | Noyes | 49/169 |
| 6,966,147 | B2 * | 11/2005 | Solowiej | 49/169 |
| 7,209,043 | B2 * | 4/2007 | Anderson, II | 340/573.3 |
| 7,458,336 | B2 * | 12/2008 | Eu | 119/51.02 |
| 7,583,931 | B2 * | 9/2009 | Eu | 455/41.2 |

(Continued)

FOREIGN PATENT DOCUMENTS

EP 1 143 092 A 10/2001

(Continued)

OTHER PUBLICATIONS

International Search Report for corresponding PCT/GB2007/050540, completed Jan. 24, 2008 by Eric Miltgen of the EPO.

*Primary Examiner* — Jerry Redman

(57) ABSTRACT

Embodiments of the invention relate to the field of pet doors, particularly selective entry pet doors based on detection of RFID tags. We describe a pet door comprising: an RFID reader to read an RFID tag on a pet; and a lock coupled to said RFID reader to control access through said pet door in response to an RFID signal from said tag; wherein said RFID reader has two modes, a first operational mode and a second, reduced power mode, and wherein said pet door further comprises: a pet proximity detector coupled to said RFID reader to identify when a pet is proximate said pet door and to control said RFID reader responsive to said identification such that when said pet is proximate said RFID is in said operational mode and such that said RFID reader is otherwise in said reduced power mode.

21 Claims, 8 Drawing Sheets

U.S. PATENT DOCUMENTS

| | | | | |
|---|---|---|---|---|
| 7,765,955 | B2 * | 8/2010 | Brooks et al. | 119/484 |
| 7,772,978 | B1 * | 8/2010 | Somogyi et al. | 340/572.4 |
| 7,852,224 | B1 * | 12/2010 | Keehn et al. | 340/573.1 |
| 7,886,486 | B2 * | 2/2011 | Lomax et al. | 49/169 |
| 7,994,919 | B2 * | 8/2011 | Vrba et al. | 340/572.1 |
| 7,997,475 | B2 * | 8/2011 | Macurek et al. | 235/375 |
| 8,025,227 | B2 * | 9/2011 | Hall et al. | 235/385 |
| 2004/0100386 | A1 | 5/2004 | Tendler | |
| 2005/0252622 | A1 * | 11/2005 | Reid | 160/180 |
| 2005/0274463 | A1 | 12/2005 | Becker | |
| 2006/0252366 | A1 * | 11/2006 | Eu | 455/3.06 |
| 2007/0051317 | A1 * | 3/2007 | Bruner | 119/53 |
| 2007/0175097 | A1 * | 8/2007 | Thorne et al. | 49/169 |
| 2007/0234643 | A1 * | 10/2007 | Siegal et al. | 49/360 |

FOREIGN PATENT DOCUMENTS

| | | | | |
|---|---|---|---|---|
| GB | 2 119 431 | A | | 11/1983 |
| GB | 2236135 | A | * | 3/1991 |
| GB | 2 305 211 | A | | 4/1997 |
| GB | 2 317 226 | A | | 3/1998 |
| GB | 2 334 067 | A | | 8/1999 |
| GB | 2 361 735 | A | | 10/2001 |
| GB | 2 381 180 | A | | 4/2003 |
| GB | 2 393 245 | A | | 3/2004 |
| GB | 2 430 331 | A | | 3/2007 |
| GB | 2 432 999 | A | | 6/2007 |
| GB | 2 433 381 | A | | 6/2007 |
| WO | WO 99/67492 | | | 12/1999 |

* cited by examiner

RFID PET DOOR

TECHNICAL FIELD

Embodiments of the invention relate to the field of pet doors, particularly selective entry pet doors based on detection of RFID tags.

BACKGROUND

A number of selective entry pet doors are known in the prior art. The most common commercial examples at present are based on detection of a magnetic tag or infra-red transmitter, where the tag is attached to the collar of the animal. In addition, there are a number of selective entry pet doors based on radio frequency detection according to the following schemes:

1) Detection of a radio transmitter attached to the cat's collar, for example GB2334067.
2) Detection of a passive resonant circuit attached to the cat's collar, for example GB2119431, and GB2305211.
3) Reading a sub-dermal RFID implant, for example GB2381180.

This last system has the following major benefits:

1) The chip has a unique identification number, allowing discrimination between the desired pet and any other animal. This is in contrast to some alternatives that have only a small selection of different keys, or even one key that only guarantees to block access by stray animals.
2) No collar-mounted tag is required. Animals that do not wear a collar may still operate this door, provided they have the sub-dermal chip. This also prevents the animal from loosing its key, for example if it becomes caught on a branch.

At present however, there are no known commercial products that implement a selective entry pet door by detection of a sub-dermal RFID chip. The main reasons for this are the power requirements and range of typical RFID readers; these are not adequate to achieve reliable operation of a battery-powered unit.

However, a new method of implementing an RFID reader has recently been described in GB0525622.7, GB0525624.3, and GB0611243.7 (hereby incorporated by reference in their entirety). This new method among other things allows the use of a high efficiency antenna, whilst maintaining sufficient communication bandwidth to determine the identification number of the RFID tag. This is in contrast to a standard reader where the antenna efficiency is inversely related to the communication bandwidth and hence the efficiency has an upper limit.

SUMMARY

We describe a selective entry pet door incorporating a high efficiency antenna. Aspects of the embodiments cover the incorporation of such an antenna into the design such that its visible impact is minimised and the effective range of the system is improved. Further aspects reduce power drain on the batteries, improving the resulting lifetime between battery changes.

The typical frequency band of standard sub-dermal RFID chips for pets is in the range 125 kHz to 134 kHz (although there is no implied limitation to these frequencies in this document). In this low frequency band an antenna is generally formed from multiple turns of wire, generating a magnetic field that is picked up by the tag through mutual inductance.

The design of a low loss coil forming the antenna is preferably comprised of the following aspects:

1) The coil should have a single thickness winding (any further winding on top of the first thickness increases the loss significantly due to proximity effects.)
2) Relatively long coil aspect ratios (ratios of coil length (L) to radius (R) in the range of L/R=0.25 to 1)
3) The antenna may use Litz wire if it can be afforded for the application. However, the invention is not limited to this type of wire and alternatives include single core copper wire and stranded copper wire.
4) Gaps between the windings of the coil can sometimes help to reduce the loss. This may be achieved by controlling the position of the wire, e.g. through ridges moulded onto a coil former, or alternatively by winding an insulated wire where the insulation provides the spacer between each winding.

The range of the antenna is partly controlled by its radius. The field generated by a current in the coil stays roughly constant up to one radius distance from the coil centre, falling off quickly at greater distances. Therefore to achieve a good range for the system, a coil of large radius is beneficial.

The critical parameter for the range is the separation between the centre of the coil and the tag. The tag is generally situated in the scruff of the neck of the animal. This position can increase the separation between the tag and the centre of the coil when the animal is attempting to pass through the door. This increased separation, combined with the requirement that the reader cope with potentially high levels of misalignment between the reader coil and the tag, gives a high performance requirement for the reader. Any antenna mounting arrangement that gives an effective increase in range is likely to improve the system reliability.

One could try to make the antenna with the maximum radius possible in order to achieve the greatest range, as shown in reference GB2305211. However, an important requirement is reliability of reading when the animal is attempting to enter the house, rather than absolute range. Often these two properties are correlated, however to achieve the maximum reliability the antenna arrangement can be improved from simply making it as large as possible. Generally the radius of the antenna should be similar to the typical separation between the antenna centre and the tag. In this way the field generated by the reader is high at the tag position, only falling off significantly at further distances. High levels of misalignment may still be tolerated provided the reader field is greater than required for ideal alignment, and the signal to noise of the measurement is also high.

According to an aspect of the invention there is provided an RFID pet door, the pet door comprising: an RFID reader to read an RFID tag on a pet; and a lock coupled to said RFID reader to control access through said pet door in response to an RFID signal from said tag; wherein said pet door includes a tunnel through which said pet must pass to pass through the pet door, said tunnel housing an access control flap at one end; and wherein said flap is at an inside end of said tunnel when said pet door is mounted in a door or wall; wherein said lock comprises a controllable stop such that when locked said stop inhibits motion of said flap to inhibit entry of a said pet, when unlocked said stop is displaced such that a said pet can gain entry via said flap and such that when both unlocked and locked a pet can exit through said flap; wherein said RFID reader includes a loop antenna formed around said tunnel; and wherein, in operation, a said pet bearing a said tag in its forequarters, inserts its head into said tunnel from an outside end of said tunnel towards said flap to enable said tag to be read by said RFID reader using said antenna to unlock said lock.

The tag may be implanted or worn (i.e. 'on' a pet is to be understood broadly as including 'in' a pet). The pet door preferably comprises a frame mounted on the inside of the house, containing the door, lock, batteries, and reader electronics. Attached to the frame is a tunnel that protrudes through the door and meets an external cosmetic frame on the outside of the door. The antenna is formed by wrapping a single thickness set of turns around the tunnel wall, achieving the following benefits:

1) A high efficiency antenna design, comprising a number of turns wound as a single thickness winding with a relatively high aspect ratio (L/R~0.5).
2) Minimal visual impact of the antenna, because of the single thickness. The coil can have the required width for high efficiency without obviously impacting the external appearance of the product.
3) Improved reliability when the cat attempts to enter the house. This is because the animal's head pokes through the antenna, resulting in a closer antenna-tag separation, due to the tag's location on the animal. Note there is a corresponding decrease in the range from the other side of the coil (animal leaving the house), however the door is only locked to entry into the house so this is of no consequence.
4) The arrangement comes close to achieving the target of antenna-tag separation similar to the coil radius. This is achieved by the dimensions of the tunnel in combination with the reduced tag-antenna. If a larger antenna were set in the frame of the unit, it may also have a similar radius to antenna-tag separation, however this would be at a larger overall distance. The proposed arrangement will therefore result in greater reliability.

Some embodiments of the antenna that are described comprise a wound antenna that is wrapped around the tunnel as a single thickness of windings. An alternative method to yield a high efficiency antenna is to use a metal foil, preferably a copper foil. In such an antenna foil is also wrapped around the tunnel with multiple windings on top of each other. This results in an antenna with a similar profile to the single thickness wire windings described previously. Such an antenna may also have a high Q and be equally applicable in the unit. The expense of such a solution is likely to be higher than a wound antenna, however it is noted here that such a foil wound antenna is considered an alternative embodiment of the invention.

According to another aspect of the invention, there is provided an RFID pet door, the pet door comprising: an RFID reader to read an RFID tag on a pet; and a lock coupled to said RFID reader to control access through said pet door in response to an RFID signal from said tag; wherein said RFID reader has two modes, a first operational mode and a second, reduced power mode, and wherein said pet door further comprises: a pet proximity detector coupled to said RFID reader to identify when a pet is proximate said pet door and to control said RFID reader responsive to said identification such that when said pet is proximate said RFID is in said operational mode and such that said RFID reader is otherwise in said reduced power mode.

The product may also comprise a low power optical detector that registers an animal attempting to enter the house. Only upon registering the attempted entry is the RFID reader powered up to read a tag, resulting in reduced battery drain in normal use.

The proximity detector comprises an LED and photodiode (or phototransistor) mounted close to the door in the tunnel roof. The LED projects light into the tunnel, which is reflected in a diffuse manner from a wide area of the base of the tunnel back up to the photodiode. An animal entering the tunnel blocks the path of the light, either before or after the reflection from the base of the tunnel, resulting in a clear drop in received signal strength at the photodiode (PD). This gives the following advantages over a standard proximity detector:

1) The optical components may be mounted on the same PCB as the RFID reader, positioned above the entrance door, with the optical components protruding down towards the tunnel. This reduces the cost to manufacture and means the detector has minimal impact on the external appearance of the product.
2) Neither the LED or PD is situated on the base of the tunnel and as such is not susceptible to small pieces of dirt obscuring the light. In fact because the reflection is over a wide area of the bottom of the tunnel it is tolerant to high levels of dirt and will still operate.
3) The PD is not open to direct sunlight, which will reduce the power requirements for the proximity detector to work with sufficient signal to noise.

According to a further aspect of the invention, there is provided an electric latchable lock, in particular for a selective entry pet door, the lock comprising: a stop moveable between two positions, a first, locking position in which said stop projects to inhibit movement of a flap of said pet door to inhibit passage of a pet in at least one direction through said pet door, and a second, retracted position in which said flap is enabled to move to allow passage of said pet in said at least one direction; an arm bearing said stop and mounted on a pivot such that rotation about said pivot causes said stop to move between said first and second positions; a bias device to bias said arm towards said locking position; an electric motor; and a camming device coupled to a shaft of said motor and having a camming surface positioned to bear against said arm and said resilient bias device such that on rotation of said motor shaft said camming surface moves to move said stop between said locking and retracted positions; whereby said stop is retractable by pressure towards said retracted position when in said locking position.

The bias device may comprise resilient bias device such as a spring, or the bias may be provided by gravity, in which case a counterbalance weight may be employed for example attached to or integrally formed with the arm.

A locking mechanism is described that requires only a minimal number of number of parts, whilst providing the following beneficial functions:

1) The door is switched open or closed and may be left in that state without additional power. This has the advantage of saving power since the door is kept unlocked for sufficient time for the animal to push the flap open. Furthermore, when the batteries eventually become drained, the door may be shut down in a safe state (either locked or unlocked, depending on the preference of the owner) and the remaining power used to indicate that the batteries need changing (e.g. flashing an LED).
2) When the lock is closed, the door may still swing shut from an open position. This avoids the need for a sensor to determine that the door is closed before locking takes place.

According to a yet further aspect of the invention there is provided an RFID tag for use with an RFID pet door, the tag comprising a metal plate, and wherein said metal plate incorporates an electronic tag and an rf loop antenna coupled to said tag.

An RFID equipped identity tag may be used with the pet door in place of a sub-dermal implant. Embodiments of our system, in particular the reader, enable such a configuration because they are able to handle the low Q and detuning which would otherwise result from the use of a metal tag.

According to another aspect of the invention there is therefore provided a pet door comprising: a frame; a tunnel attached to said frame; a moveable flap configured to allow opening of the flap in a direction towards the tunnel and selective opening of the flap in a direction away from the tunnel, and; a lock for controlling said selective opening; an antenna disposed around the tunnel; and a receiver coupled to said antenna configured to operate said lock responsive to receiving a signal from said antenna.

According to another aspect of the invention there is therefore provided a pet door for allowing selective entry into a building of an animal carrying a tag, comprising: a frame; a tunnel attached to the frame; a moveable flap configured to allow opening of the flap in a direction towards said tunnel and selective opening of the flap in a direction away from said tunnel; lock for controlling said selective opening; a receiver configured to operate said lock responsive to receiving a signal from a said tag; and a proximity detector for detecting when a said animal is proximate said pet door; wherein the proximity detector is configured to apply power to said receiver responsive to said detecting.

According to another aspect of the invention there is therefore provided a pet door comprising: a frame; a moveable flap configured to allow unrestricted opening of said door in a first direction and selective opening of said door in a second direction; a lock for controlling said selective opening; an arm having a catch, said arm being pivotally mounted on said pet door and having two configurations, a first configuration in which the catch is disposed to prevent opening of the door in said second direction, and a second configuration in which the catch is disposed to permit opening of the door in said second direction; and a motor having a drive shaft and a cam disposed on said drive shaft, the cam being configured to put the arm into said first configuration when the motor is driven in a first direction and to put the arm into said second configuration when said motor is driven in a second direction.

Features of the above described aspects and embodiments of the invention may be combined in any permutation.

BRIEF DESCRIPTION OF THE DRAWINGS

FIG. 2 is a drawing of the optical proximity detector viewed face on.

FIG. 3 is a drawing of the optical proximity detector viewed side on.

FIG. 7 shows a set of drawings of an RFID tag in combination with a visual identity tag.

DETAILED DESCRIPTION

Figure 1:
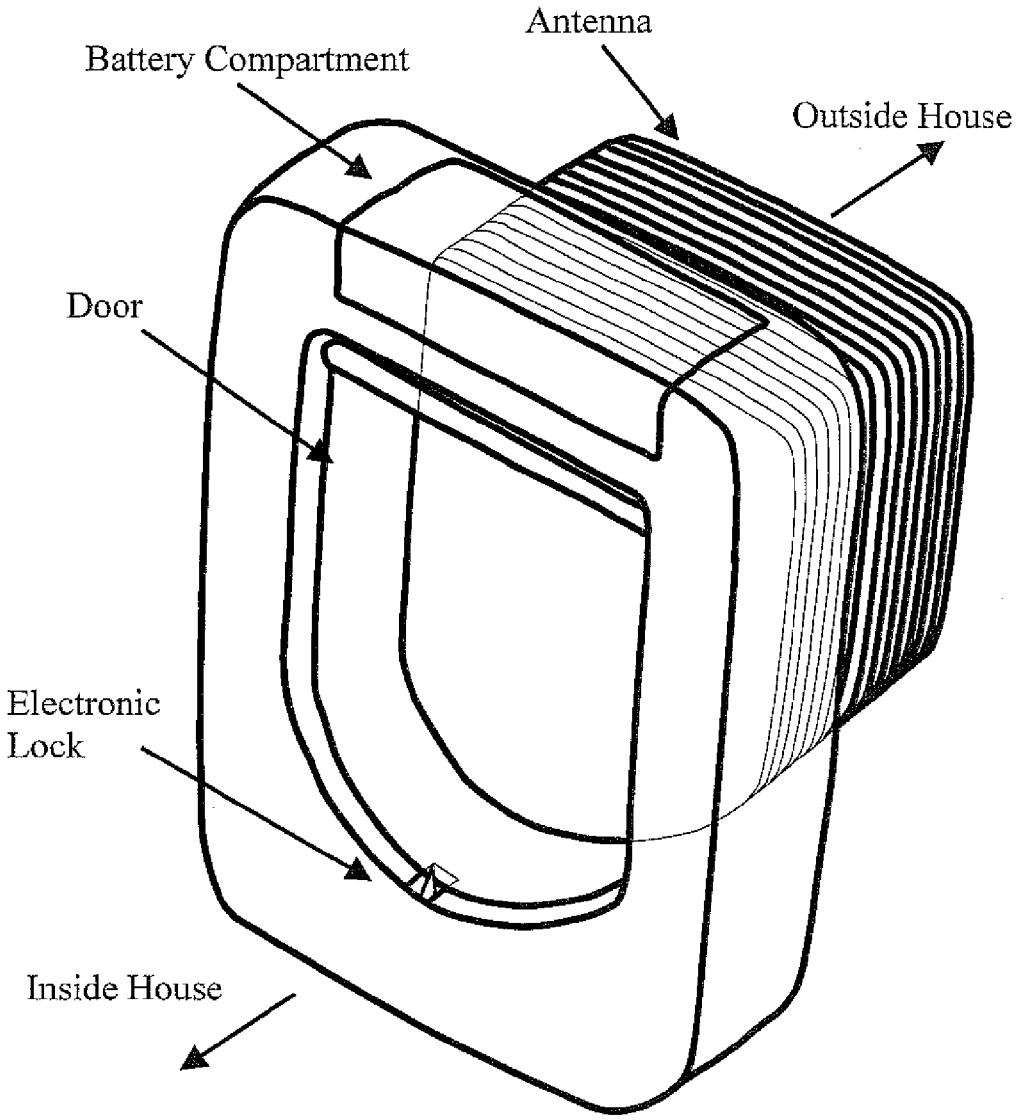
FIG. 1 is a drawing of an embodiment of the pet door, showing the antenna wrapped around the tunnel between the inside and outside of the house.

FIG. 1 shows a drawing of an embodiment of the invention. The pet door comprises a frame that supports the door and a battery compartment, together with the electronic locking mechanism. The frame mounts on the inside of the house, for example on a door or wall. A tunnel protrudes from the frame through to the outside of the house and will often be surrounded by a separate cosmetic frame mounted outside (not shown).

The low loss antenna is made up from a single layer of wire turns, wrapped around the tunnel wall. This embodiment uses 38 turns of Litz wire; the Litz wire comprises 42 strands of 36 AWG size copper. The total winding width of the coil is 50 mm.

Note that there may be an additional cover for the tunnel to enclose the antenna, for protection and/or cosmetic appeal.

Figure 2:
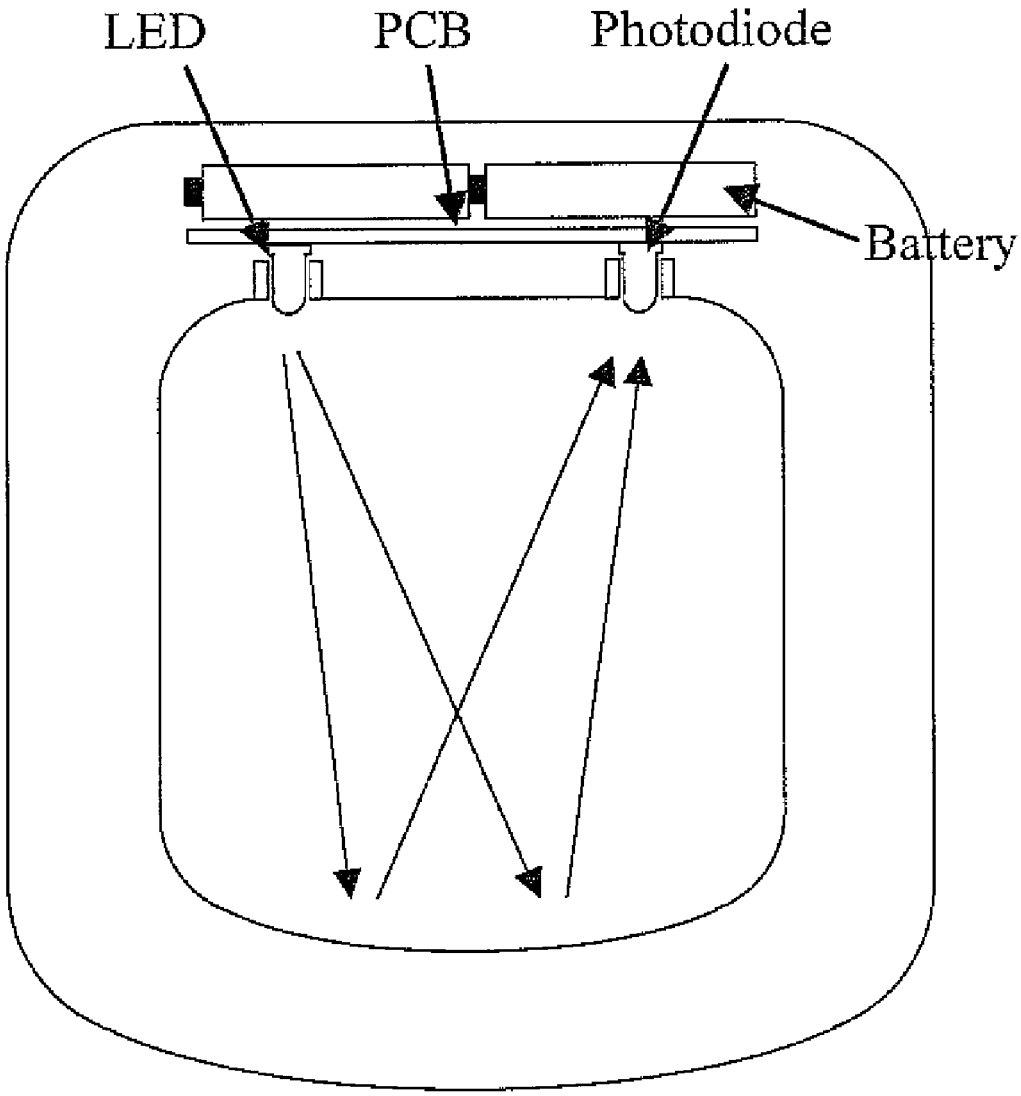

FIG. 2 shows a diagram of the pet door from a face-on position. The batteries, PCB and optical components of the proximity detector are indicated. The proximity detector comprises an infrared LED and photodiode situated on opposite sides of the top surface of the tunnel, through which the animal passes. Light emitted by the LED is incident on the bottom of the tunnel and is reflected back up in a diffuse manner. Two different possible light paths are shown, illustrating that a large proportion of the access hole is covered by light undergoing the single reflection from the tunnel bottom.

The bottom of the tunnel is shown curved in this embodiment, however because the reflection is diffuse, the precise shape of the tunnel is not critical and a flat-bottomed tunnel would be equally applicable. The texture of the tunnel may optionally be patterned to promote a diffuse reflection, for example through a matt finish. Alternatively the tunnel shape may be shaped to focus the light from the LED to the photodiode, in which case a specular reflection would also give good performance.

When the animal comes to enter the house, it puts its head into the tunnel and blocks some of the light paths between the LED and photodiode. This reduces the measured intensity, and the proximity of the animal is registered. Note that the spatial separation of the LED and photodiode helps to eliminate a complication that could otherwise arise from a direct reflection from the animal. In the arrangement shown, when the animal's head is in the path of the light emitted by the LED, very little light will be scattered through the large angle required to hit the photodiode. Furthermore, the photodiode has low sensitivity at high angles, reducing the amplitude of any signal associated with a direct reflection to an even lower level. If the LED and photodiode were, however, closely spaced then a direct reflection may give rise to a large signal, particularly if the animal has reflective fur (e.g. a white cat). In this case there would not be the expected drop in measured intensity and the animal's presence may not be reliably registered.

The shape of the openings in the top surface of the tunnel for the LED and photodiode may be designed to control their angular sensitivity. For example, recessing the LED and photodiode in the moulding will reduce there sensitivity to large angles, ensuring that the measured signal is a result of the reflection from the bottom surface, rather than any direct reflection from the animal, as described above. Furthermore, the moulding may be used to block any significant direct optical cross talk between the LED and photodiode. Such cross talk would not be blocked by the presence of the animal and would therefore simply serve to degrade the signal quality.

The optical detector is required to operate in the presence of sunlight. In this embodiment an infrared LED and photodiode are used, where the photodiode has an optical filter to attenuate the effects of visible light. Never the less, there will be some effect of sunlight on the photodiode, either from the infrared component of sunlight or the residual level of visible light that passes through the filter. Features of the embodiment that minimise the effect of sunlight may include:

- The position of the photodiode on the top surface of the tunnel means that it is never exposed to direct sunlight. Sunlight reflected by the bottom of the tunnel will be lower in comparison.
- The measurement of the intensity is performed at ac, with the LED being pulsed at the same frequency to which the photodiode amplifier is tuned. The frequency of the measurement is 25 kHz in this embodiment.
- The measurement is not performed continuously, rather the intensity is registered 10 times per second. This is sufficient to allow entry to the animal without a noticeable delay. Polling the measurement in this manner allows greater power to be used for a given battery drain. This helps to separate the measurement signal from the noise generated by sunlight.

Note that the invention is not limited to an infrared LED and photodiode; a similar pair that operate in the visible spectrum would also be an option provided the effects of sunlight are mitigated by any other measured taken.

Figure 3:
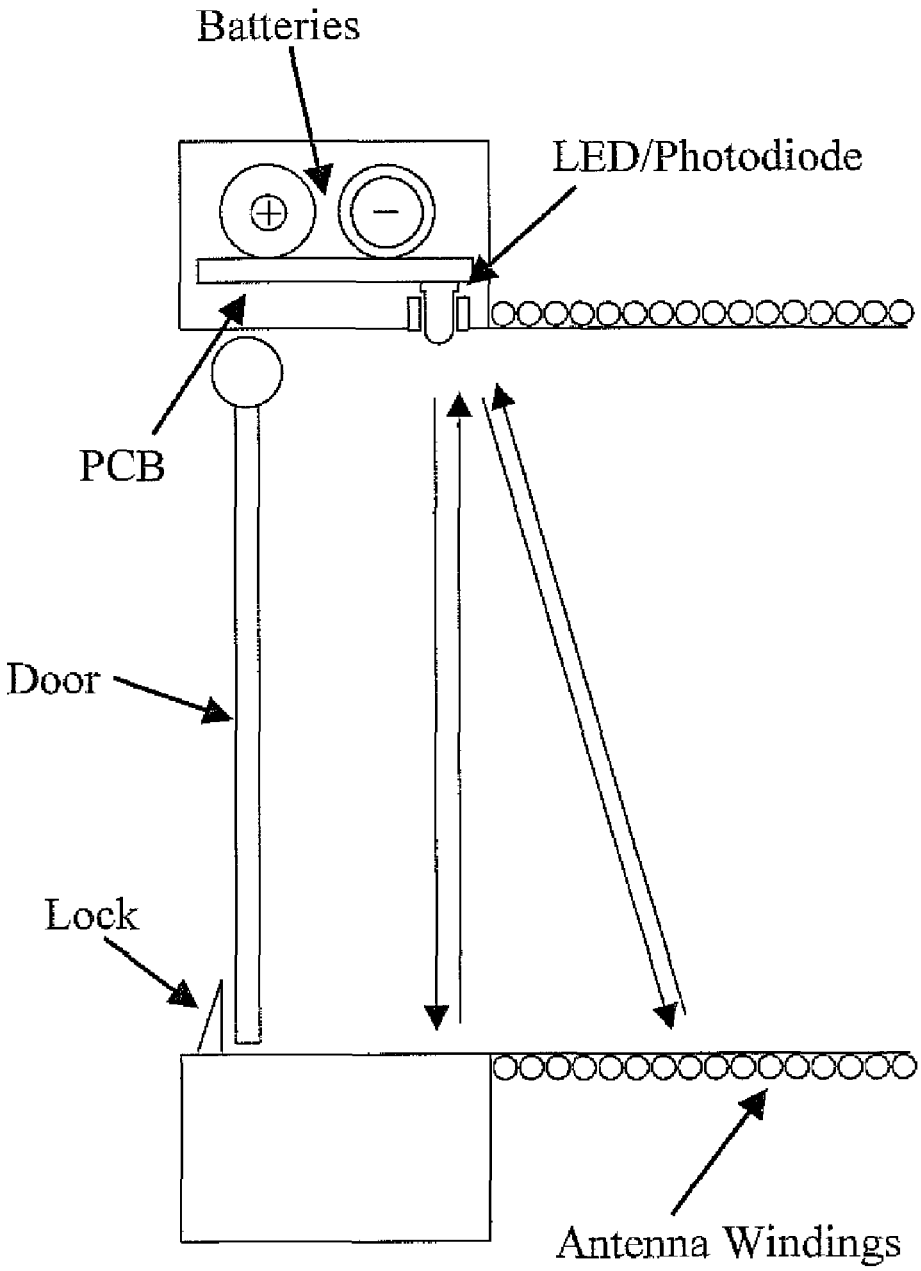

FIG. 3 shows the side-on perspective of the pet door, illustrating the position of the optical components, supporting PCB, and batteries. From this perspective the LED and photodiode overly each other, lying in the same plane. The PCB that supports the optical components also preferably supports the RFID reader electronics, and is connected to the antenna that surrounds the tunnel. Two possible light paths from the LED to the photodiode via a diffuse reflection from the bottom of the tunnel are shown.

Figure 4:
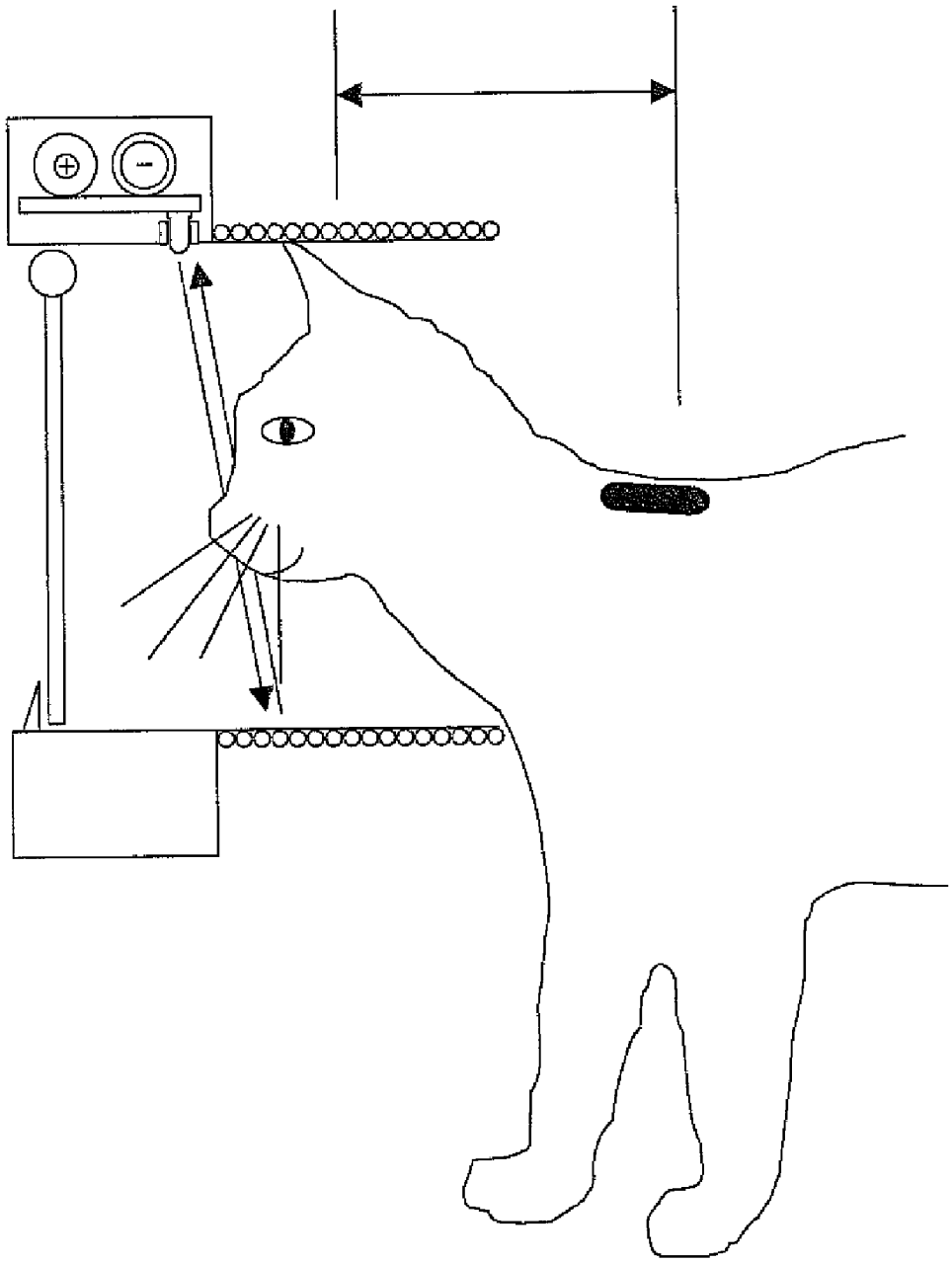
FIG. 4 is a drawing of an animal entering the door from outside the house.

FIG. 4 shows the same side on perspective as FIG. 3, this time including a drawing of a cat about to enter the house. As the animal enters the tunnel, some of the possible light paths are blocked, as shown. The drop in intensity may be measured and the presence of the animal registered.

FIG. 4 also illustrates a key advantage of the antenna arrangement. Because the door need only be locked to an animal entering the house, its position on this side of the door gives an effective increase in the range and reliability of the system. In order to enter the house the animal will touch the door with its head. Because the tag is situated behind the head of the animal, the arrangement shown reduces the antenna-tag separation. The relevant distance is indicated by a double-headed arrow.

Figure 5:
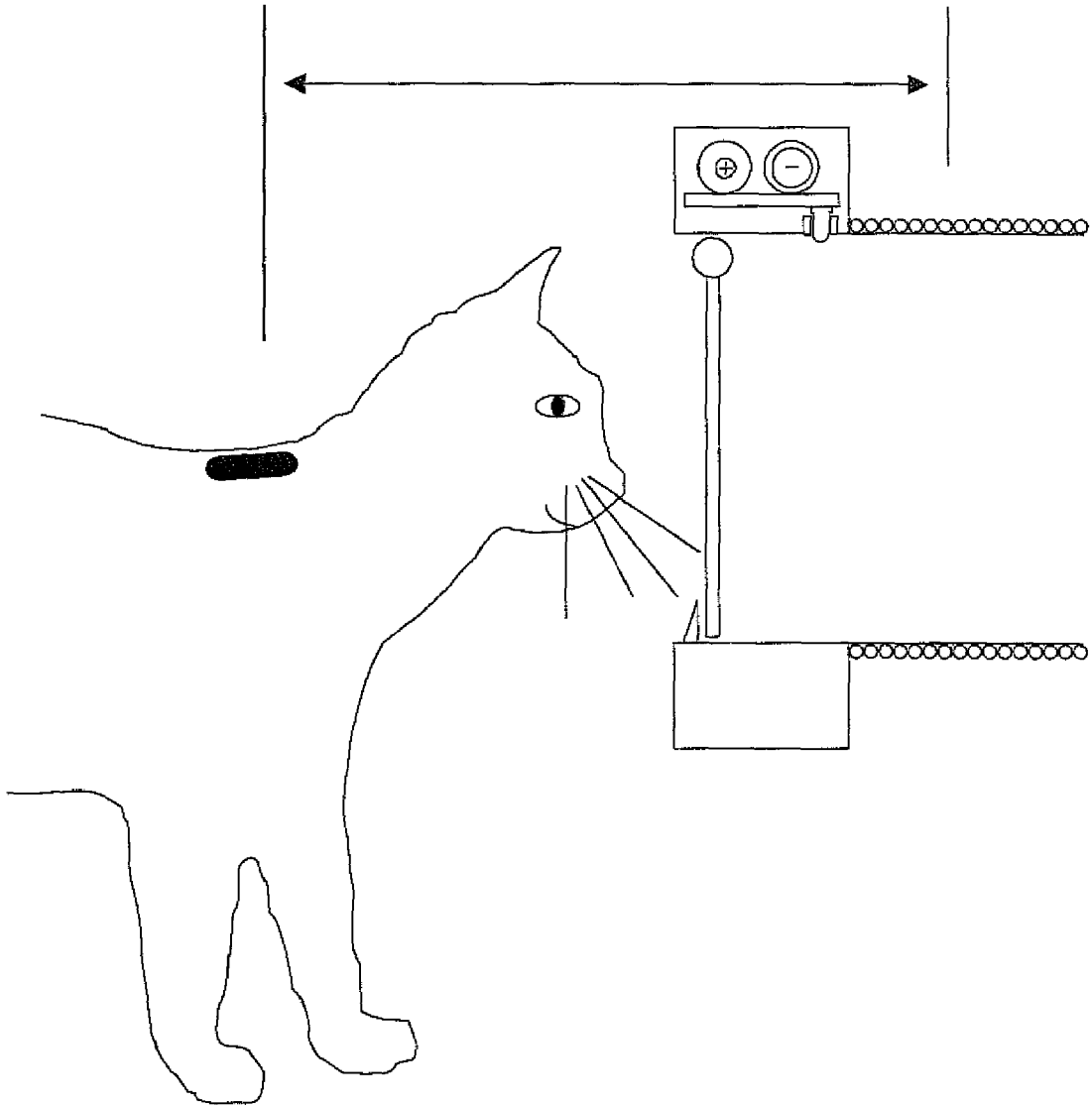
FIG. 5 is a drawing of an animal entering the door from inside the house.

FIG. 5 shows the corresponding diagram for the animal leaving the house. It is clear that the chosen arrangement for the antenna increases the antenna-tag separation for this situation. This would reduce the effective range of the system on this side, however the door is not locked to the animal leaving the house and this is therefore of no consequence. The antenna arrangement effectively trades improved range for an animal entering the house for lower range leaving.

The optical detector is likewise not designed to register an animal on the inside of the house, only the presence within the tunnel. Note that when the animal leaves the house then it will lead to a triggering of the optical detector when the door is open and the animal is halfway out. An optional sensor to determine whether the door is open or closed may be used to differentiate between the animal about to enter the house (door closed) or in the process of leaving (door open). Such a sensor would enable the RFID reader to be powered up only for an animal entering the house, saving any unnecessary battery drain with its operation on leaving the house.

Figure 6:
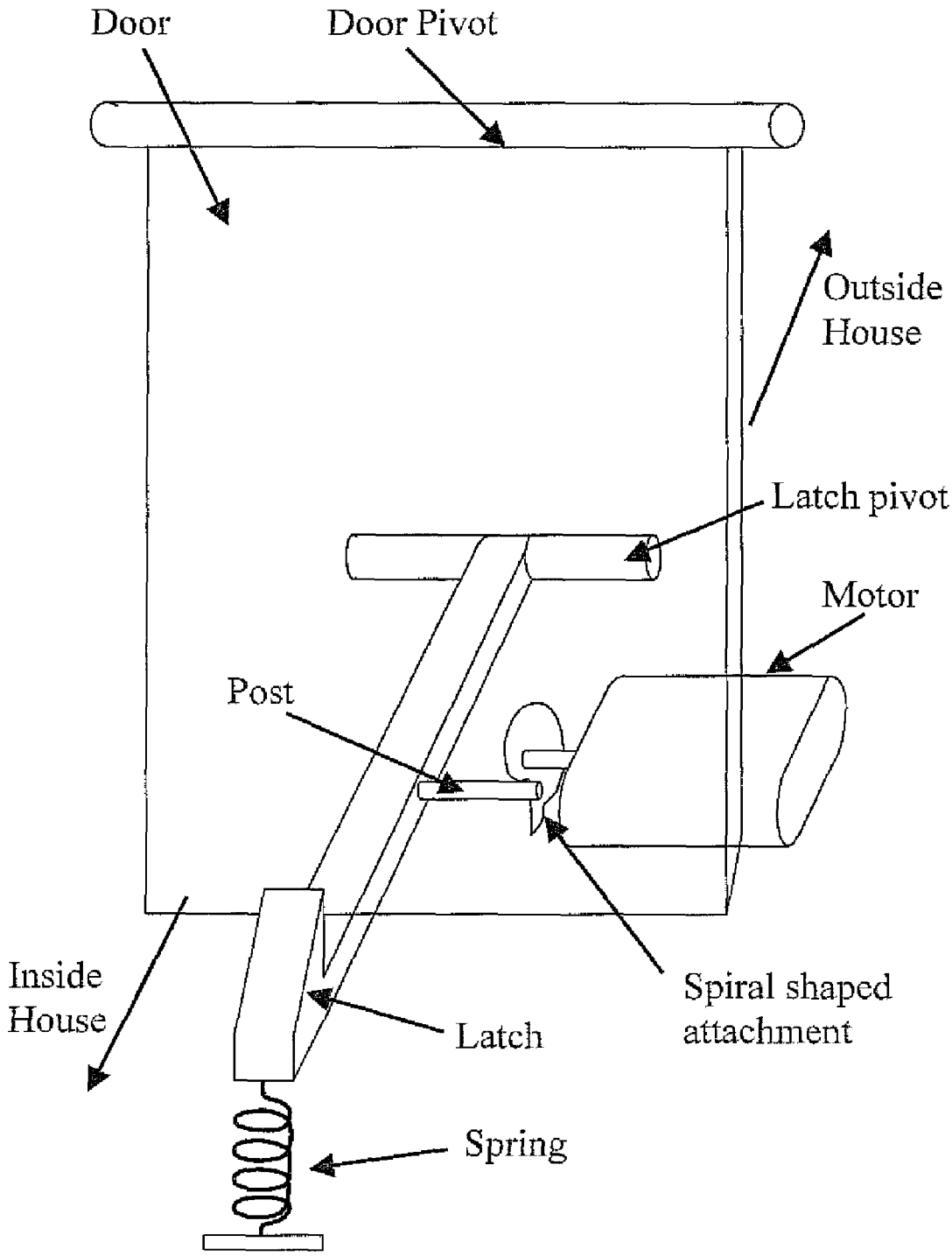
FIG. 6 is a drawing of an embodiment showing the door locking arrangement.

FIG. 6 shows a drawing of the hinged door together with the components of an electronically controlled lock. The door is hinged at the top, forming a flap in the normal way for such a pet door. The directions of the outside and inside of the house are indicated with arrows. A latch is situated under the door and is hinged behind the door. The end of the latch is sloped in one direction, as shown. There is also a spring that pushes the latch up into the closed state.

The latch has a post that sticks out to the side. This engages with a motor via a spiral shaped attachment. Rotation of the motor through an almost complete turn switches the latch from a locked state to an unlocked state. The operation of the latch will now be described in some more detail.

The latch is currently shown in its locked state. When an animal attempts to enter the house, the door is locked against the flat portion of the latch. However the door is free to open to the outside, allowing the animal to leave the house when it desires.

The door is opened by the motor rotating anti-clockwise by an almost compete turn. The attachment between the motor and the post has a spiral-like shape, such that its rotation gradually pushes the post downwards. This in turn leads to the end of the latch depressing, moving it away from the position that blocks the door from opening inwards. The door is therefore now free to open inwards and outwards. Note the spiral shape attachment also has a shape that stops the rotation of the motor after almost one complete turn (a protrusion that hits against the post). When it comes to locking the door again, the motor is rotated in the reverse direction and the latch is pushed up to the locked position by the spring.

When the door has been locked after allowing the animal entry into the house, it may be that the door remains open. For example the animal may be slow to enter the house and the latch switched to the locked position after a fixed amount of time. Once the animal fully enters the house, the door will swing down to the closed position. Here the sloped shape of the latch allows the door to depress the latch and move past it to its closed rest position. Once it has closed the latch is forced up by the spring to the locked position. The feature that allows this operation is that the latch is not fixed to the motor, rather it is in pressure contact with the motor attachment. When the latch is depressed by the door closing, the post breaks contact with the motor attachment, coming back into contact after the door comes to rest in its closed position. Such operation would not be possible with a fixed connection between the motor and the latch, in which case a sensor would be required to determine that the door was closed before the latch could be locked. In this manner the arrangement shown uses a small number of parts and avoids the additional expense of a sensor.

In this embodiment a spring is used to push the latch upward to rest in the locked position, provided the motor is switched to the clockwise position. An alternative is to place a weight the other side of the pivot that will be pulled down by gravity. Provided this is of sufficient mass to counterbalance the weight of the latch, it will force the latch position in the same direction as the spring shown. This may lead to a cost saving, either through the elimination of the spring component, or by making assembly of the unit simpler and quicker.

The latch arrangement shown is stable both in the locked and unlocked states. The controlling electronics simply has to send a current through the motor in the right direction to switch the latch from closed to open, and vice versa. The advantages of this feature include:

Power is saved by not having to keep current flowing for the duration that the door is open. This leads to longer battery life.

When the batteries eventually run out, the system can be shut down into a pre-determined safe state. This would likely be that the door is left unlocked, although this could be locked depending on the preference of the owner. The remaining power may be used to indicate that the batteries are low, for example by flashing a visible LED.

FIG. 7 shows an RFID equipped identity tag that may be mounted to the animal's collar in place of the sub-dermal implant. Although the use of such an RFID tag does not benefit from the features of the sub-dermal implant (no collar needed, tag cannot be lost, etc) it may be a convenient alternative since it may be used without a visit to a vet to insert a chip. If the animal already wears a collar then it will usually have a visible identity tag, in which case combining this with the RFID tag avoids the need to attach two separate items to the collar. The most damaging result from having two separate units is that the identity tag is usually metal, which if in close contact to the RFID tag may alter its properties. In particular, the metal tag may change the resonant frequency and Q of the tag, leading to unreliable operation.

Figure 7A:
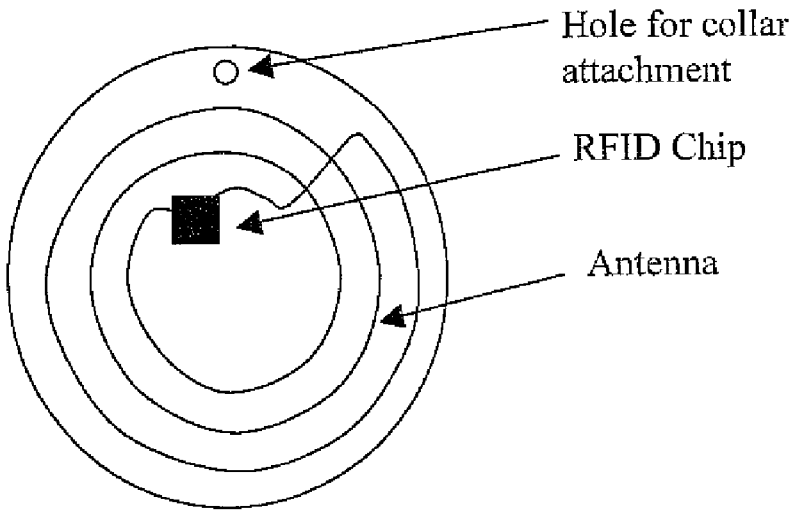
FIG. 7A shows the RFID tag, where the antenna, RFID chip, and mounting hole are indicated.

RFID tags with form factors suitable for animal identity tags are well known in the art. FIG. 7A shows a typical tag, where a spiral shaped printed antenna is shown on a circular disk. When combining the function of such a device with an identity tag, one approach would be to mark the animal's address on the external tag surface. The RFID tags generally have a plastic outer casing, or some other non-metallic material, in order to avoid influencing the tag properties. However, this material is likely to be less robust than a conventional metal tag, and be prone to either breaking off or scratching of the information marked on the surface.

Figure 7B:
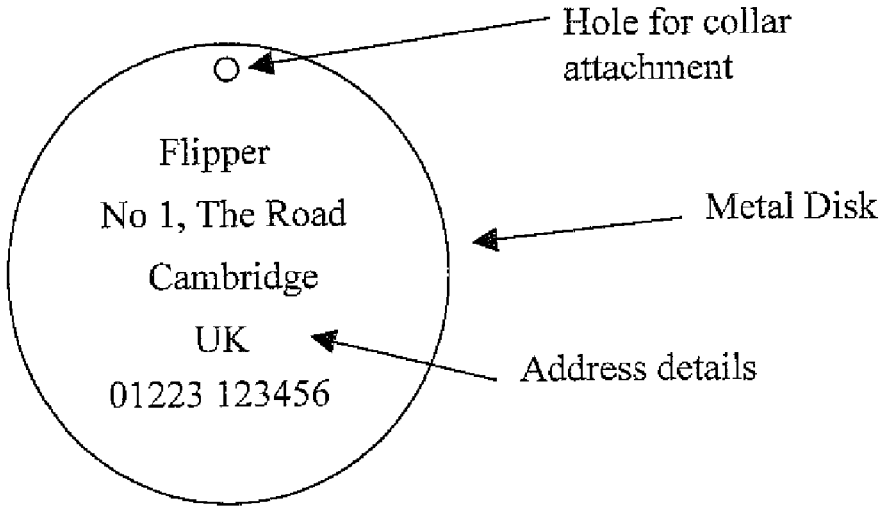
FIG. 7B shows a visual identity tag where the mounting hole is indicated and the home of the animal is marked on the tag.
Figure 7C:
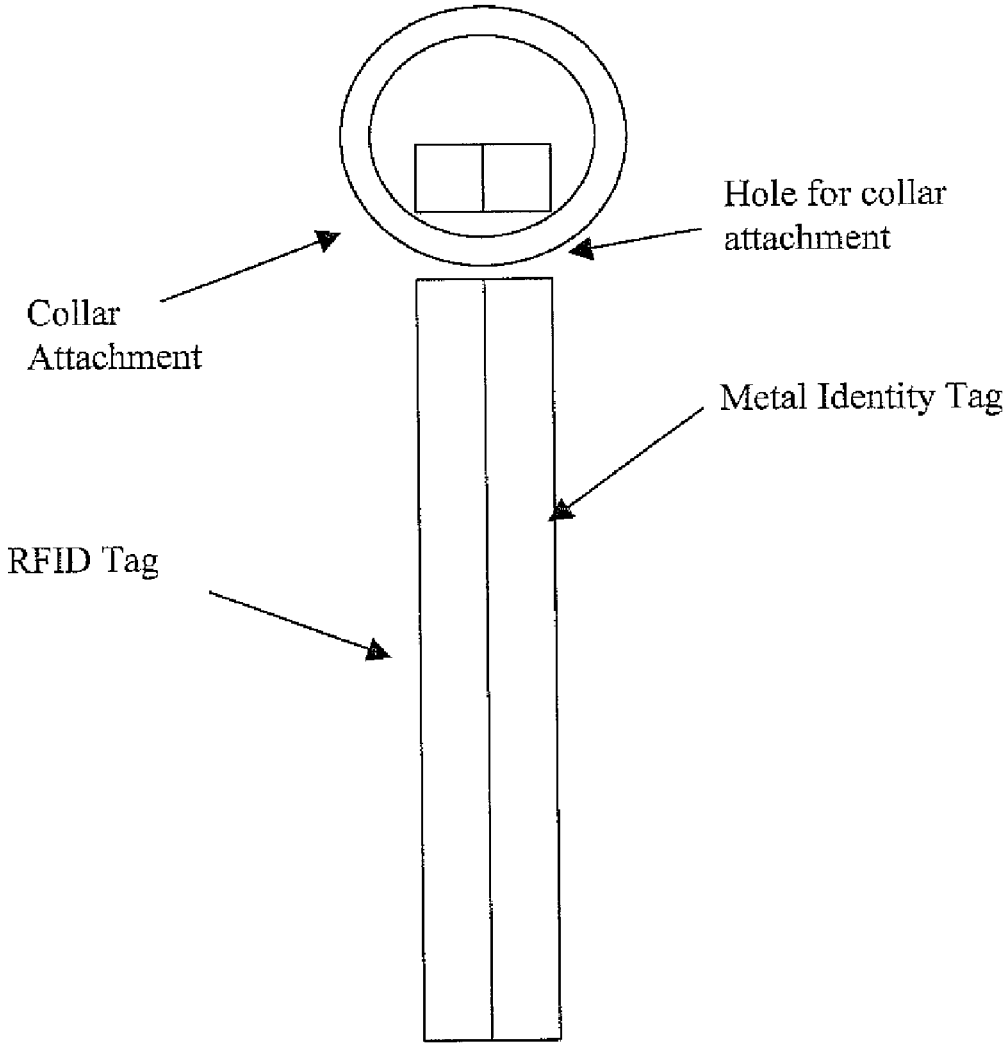
FIG. 7C shows a side-on perspective of the RFID tag/visual identity tag combination.

In this embodiment a metal identity disk is attached to the front of the RFID tag. A typical identity disk is shown in FIG. 7B, and the combined RFID equipped identity tag is shown in FIG. 7C. Such a combination will have good robustness to either breaking or scratching, comparable to a conventional identity tag. This arrangement would not be considered with a conventional reader, because of the detrimental effect of the metal on the antenna.

The reader employed in the pet door is designed for use with typical sub-dermal RFID tags. These have a small size and a correspondingly low coupling constant to the reader antenna; this requires very a high performance reader. However, when operating with the collar mounted RFID tag, the task of reading is made significantly easier by the greater coupling constant associated with the tag dimensions. The reader has a sensitivity that is much greater than the minimum required for reliable operation. As a result the system will not only operate with high levels of misalignment of the collar mounted tag, but may also tolerate the adverse affect of the metal identity tag on the RFID tag.

A further aspect of the tag that may improve the reliability of the system is the material composition of the identity tag. A ferromagnetic material such as steel or ferrite will generally increase the inductance of an antenna, lowering its resonant frequency. A highly conductive material on the other hand, such as copper, serves to lower the inductance through eddy currents. There is therefore the potential to construct an identity tag that does not change the resonant frequency of the tag, only affecting its Q. Such a construction may be achieved through the proper choice of metal or alloy for the disk. Alternatively, a layered construction of ferromagnetic and conductive materials may be employed.

A further alternative is to design the tag antenna to operate in combination with the identity tag, such that the target resonant frequency and/or Q results only when the metal tag comes into close proximity.

Thus in summary, we have described use of a tunnel as the coil former to achieve a high Q coil and better range for an animal entering the house.

Preferably the antenna comprises a single thickness winding of wire, Litz wire, solid copper wire, or stranded copper wire, etc. We have also described an antenna comprising a multiple windings of foil, and an optical detector that registers when an animal is attempting to enter the house, relying on the interruption of a light path from a light source to a light sensor via a reflection from the tunnel.

We have described a texture of the tunnel to promote a diffuse reflection, a shape of the tunnel to focus the light from the source to the sensor, and a locking mechanism, as disclosed. We have also described incorporation of an RFID tag into a collar-mounted identity tag, for example where the identity tag is metal, or where the metal tag is designed to leave the resonant frequency of the tag unchanged or where the RFID tag antenna is designed to reach its target resonant frequency and Q when in close proximity to the metal identity tag.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. An RFID pet door, the pet door comprising:

an RFID reader to read an RFID tag on a pet; and a lock coupled to said RFID reader to control access through said pet door in response to an RFID signal from said tag;

wherein said RFID reader has two modes, a first operational mode and a second, reduced power mode, and wherein said pet door further comprises:

a pet proximity detector coupled to said RFID reader to identify when said pet is proximate said pet door and to control said RFID reader responsive to said identification such that when said pet is proximate said RFID is in said operational mode and such that said RFID reader is otherwise in said reduced power mode.

2. An RFID reader pet door as claimed in claim 1 wherein power to said RFID reader is switched off in said second mode.

3. An RFID reader pet door as claimed in claim 1 wherein said pet door includes a tunnel through which said pet must pass to pass through the pet door;

wherein said pet proximity detector comprises a light emitter and a light detector; and wherein said light detector is configured to respond mainly to light from said light emitter reflected by said tunnel into said light detector;

whereby proximity of said pet is detected by a detection of a reduction in a level of said reflected light.

4. An RFID reader pet door as claimed as claimed in claim 3 wherein said light emitter and said light detector are positioned within an angle of 90° to one another on a top surface of said tunnel looking down.

5. An RFID reader pet door as claimed in claim 3 wherein said light detector is shielded from direct sunlight when said pet door is mounted in a door or wall.

6. An RFID pet door, the pet door comprising:

an RFID reader to read an RFID tag on a pet; and a lock coupled to said RFID reader to control access through said pet door in response to an RFID signal from said tag;

wherein said pet door includes a tunnel through which said pet must pass to pass through the pet door, said tunnel housing an access control flap at one end; and wherein said flap is at an inside end of said tunnel when said pet door is mounted in a door or wall;

wherein said lock comprises a controllable stop such that when locked said stop inhibits motion of said flap to inhibit entry of said pet, when unlocked said stop is displaced such that said pet can gain entry via said flap and such that when both unlocked and locked said pet can exit through said flap; wherein said RFID reader includes a loop antenna formed around said tunnel; and wherein, in operation, said pet bearing said tag in its forequarters, inserts said pet's head into said tunnel from an outside end of said tunnel towards said flap to enable said tag to be read by said RFID reader using said antenna to unlock said lock.

7. An RFID pet door as claimed in claim 6 wherein said loop antenna comprises a single layer of turns around said tunnel.

8. An RFID pet door as claimed in claim 6 wherein said loop antenna has length to maximum loop dimension aspect ratio of at least 0.25.

9. A selective entry pet door with an electric latchable lock, the lock comprising:

a stop moveable between two positions, a first, locking position in which said stop projects to inhibit movement of a flap of said pet door to inhibit passage of a pet in at least one direction through said pet door, and a second, retracted position in which said flap is enabled to move to allow passage of said pet in said at least one direction;

an arm bearing said stop and mounted on a pivot such that rotation about said pivot causes said stop to move between said first and second positions;

a bias device to bias said arm towards said locking position;

an electric motor; and a camming device coupled to a shaft of said motor and having a camming surface positioned to bear against said arm and said resilient bias device such that on rotation of said motor shaft said camming surface moves to move said stop between said locking and retracted positions;

whereby said stop is retractable by pressure towards said retracted position when in said locking position.

10. A selective entry pet door as claimed in claim 9 wherein said camming device surface has generally spiral shape.

11. A selective entry pet door as claimed in claim 10 wherein said generally spiral camming surface has a stop at each end of said spiral.

12. A selective entry pet door as claimed in claim 9 wherein said resilient bias device comprises a compression spring.

13. A selective entry pet door as claimed in claim 9, wherein said arm is in pressure contact with said camming surface, without having direct attachment to said camming device or surface.

14. A selective entry pet door as claimed in claim 9 in combination with an RFID tag, the tag comprising a metal plate, and wherein said metal plate incorporates an electronic tag and an rf loop antenna coupled to said tag.

15. A selective entry pet door as claimed in claim 14 wherein said plate comprises an engraved metal disc.

16. A pet door comprising:

a frame;

a tunnel attached to said frame;

a moveable flap configured to allow opening of the flap in a direction towards the tunnel and selective opening of the flap in a direction away from the tunnel, and;

a lock for controlling said selective opening;

an antenna disposed around the tunnel; and a receiver coupled to said antenna configured to operate said lock responsive to receiving a signal from said antenna.

17. A pet door as claimed in claim 16, wherein the antenna comprises litz wire.

18. A pet door as claimed in claim 17, wherein said receiver comprises an RFID receiver, and said signal comprises an RFID signal.

19. A pet door as claimed in claim 16 wherein the antenna comprises a coil, in particular a coil comprising a single layer of windings.

20. A pet door as claimed in claim 19 wherein a ratio of a length of the coil to a radius of the coil is in the range 1:4 to 1:1.

21. A pet door as claimed in claim 19 wherein the coil has gaps between two or more windings of the coil to reduce losses in the coil.

* * * * *